US006190003B1

(12) United States Patent
Sato et al.

(10) Patent No.: US 6,190,003 B1
(45) **Date of Patent: *Feb. 20, 2001**

(54) ELECTROSTATIC ACTUATOR AND MANUFACTURING METHOD THEREFOR

(75) Inventors: Kazuhiko Sato; Hiroyuki Maruyama; Masahiro Fujii; Tadaaki Hagata; Koji Kitahara; Keiichi Mukaiyama, all of Suwa (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/993,788

(22) Filed: Dec. 19, 1997

(30) Foreign Application Priority Data

Dec. 20, 1996 (JP) ..... 8-342213
Oct. 16, 1997 (JP) ..... 9-284127

(51) Int. Cl.[7] ..... B41J 2/06
(52) U.S. Cl. ..... 347/54
(58) Field of Search ..... 347/54, 55, 9, 347/10, 11, 68, 69, 70, 71, 72, 50, 40; 29/890.1; 399/261

(56) References Cited

U.S. PATENT DOCUMENTS

| | | | | |
|---|---|---|---|---|
| 4,937,596 | | 6/1990 | Schmid . | |
| 5,144,340 | * | 9/1992 | Hotomi et al. | 347/55 |
| 5,331,454 | | 7/1994 | Hornbeck . | |
| 5,501,870 | | 3/1996 | Shiraishi et al. . | |
| 5,534,900 | * | 7/1996 | Ohno et al. | 347/54 |
| 5,725,987 | * | 3/1998 | Combes et al. | 430/137 |

FOREIGN PATENT DOCUMENTS

| | | |
|---|---|---|
| 39 18 472 | 12/1990 | (DE) . |
| 0 580 283 | 1/1994 | (EP) . |
| 5-50601 | 3/1993 | (JP) . |
| 6-71882 | 3/1994 | (JP) . |
| 7-13007 | 1/1995 | (JP) . |
| WO 93/14422 | 7/1993 | (WO) . |
| WO 95/18249 | 7/1995 | (WO) . |

OTHER PUBLICATIONS

Article Entitled: "*Surface Forces In Micromachined Structures*" by P.R. Scheeper, et al., University of Twente, P.O. Box 217, 7500 Ae Enschede, The Netherlands.

* cited by examiner

*Primary Examiner*—John Barlow
*Assistant Examiner*—Raquel Yvette Gordon

(57) ABSTRACT

An electrostatic actuator comprising opposing electrode members displaced relatively by an electrostatic force is provided with improved durability so that electrostatic attraction between opposing members does not drop and the opposing electrode members do not stick together. Hydrophobic films of hexamethyldisilazane (HMDS) are formed on a surface of segment electrode and a bottom surface of a diaphragm (common electrode) of an eletrostatic actuator wherein the diaphragm forms a wall of an ink chamber in an ink jet head. HMDS molecules are smaller than PFDA molecules, and a uniform, variation-free hydrophobic film can therefore be formed even when the gap between opposing electrodes is narrow. Durability and film stability of a HMDS hydrophobic film are also high. An electrostatic actuator with high durability and operating stability can thus be achieved.

17 Claims, 11 Drawing Sheets

ELECTROSTATIC ACTUATOR AND MANUFACTURING METHOD THEREFOR

BACKGROUND OF THE INVENTION

1. Field of the Invention

The present invention relates to an electrostatic actuator using an electrostatic force for displacing opposing electrode members relative to one another, wherein the electrostatic force is generated by a drive power source which applies a voltage between the opposing electrodes. The invention also relates to a method for manufacturing such an electrostatic actuator. More specifically, the present invention relates to a method for forming a hydrophobic film on the surface of at least one of the two electrode members of the electrostatic actuator.

2. Description of the Related Art

Actuators with a microstructure formed using semiconductor microprocessing technologies are widely used in ink jet heads for ink jet printers. These microstructure actuators can be driven in various ways, one of which is electrostatic drive, a method that uses electrostatic force for drive power. Examples of ink jet heads that use electrostatic force to eject ink drops may be found in JP-A-5-50601 (1993), 6-71882 (1994) and EP-A-0 580 283.

This type of ink jet head has, in communication with each nozzle, a respective ink chamber whose bottom is formed as an elastically deformable diaphragm. The diaphragm is disposed opposite a substrate with a certain gap therebetween. Mutually opposing electrodes are also disposed on or by the diaphragm and substrate, respectively, and the space between the electrodes is sealed. In this case, the diaphragm and the substrate form the two opposing electrode members of the electrostatic actuator. When a voltage is applied to the electrodes, the electrostatic force created in the gap causes the bottom of the ink chamber, i.e., the diaphragm, to vibrate as a result of the electrostatic attraction to and repulsion from the substrate. The change in the internal pressure of the ink chamber resulting from this vibration of the ink chamber bottom causes one or more ink drops to be ejected from the ink nozzle. A so-called "ink-on-demand" drive method whereby ink drops are ejected only when needed for recording can thus be achieved by controlling the voltage applied to the electrodes of the electrostatic actuator.

If moisture gets on the opposing surfaces of the opposing electrodes (i.e., on the bottom surface of the ink chamber and on the opposing surface of the opposing substrate) while the ink jet head is being driven by repeatedly applying a voltage to the electrodes, the charge of polar molecules may cause a drop in electrostatic attraction or repulsion properties. If polar molecules adhering to the opposing surfaces form hydrogen bonds, the bottom of the ink chamber (i.e., the diaphragm) may stick to the substrate and can become inoperable.

One possibility of avoiding these problems is to treat the opposing surfaces so that they are made hydrophobic. One means of achieving this is to coat these surfaces with an oriented monolayer of perfluordecanoic acid (PFDA).

An electrostatic actuator which is used for moving micro mirrors and in which PFDA is used for hydrophobic treatment is proposed, for example, in JP-A-7-13007 (1995) and in corresponding U.S. Pat. No. 5,331,454. These documents are directed to a method of preventing the opposing electrode surfaces of the actuator from sticking together when driven by forming an oriented monolayer of PFDA on these surfaces.

Hydrophobic processing using PFDA, however, leaves the following problems to be solved. First, the durability of the PFDA layers formed by simply depositing PFDA on the opposing surfaces of electrode members displaceable relative to one another is insufficient. Consequently, the PFDA layer separates from the surface of the underlying electrode members as a result of the electrostatic field being repeatedly generated between the electrode members to repeatedly displace them relative to each other. These separated layer particles then tend to clump together, creating foreign matter inhibiting relative displacement between the electrode members. When such foreign matter is formed, the danger of the electrostatic actuator becoming inoperable arises.

The gap between opposing electrode members in an electrostatic actuator is preferably as narrow as possible in order to generate a sufficiently high electrostatic force at a relatively low voltage. It is also preferable to minimize this gap as much as possible in order to reduce the size and to achieve a higher density arrangement of electrostatic actuators. PFDA molecules are relatively large, however, and if the gap becomes too narrow, it is not possible to deposit PFDA on the opposing surfaces separated by this narrow gap.

It has also been proposed to use a hexamethyldisilazane (HMDS) film to prevent relatively movable members in a microstructure from sticking together. However, such proposal does not provide any suggestion of sealing a gap in an electrostatic actuator using an HMDS film in the manner proposed by the present inventors.

Therefore, it is an object of the present invention to overcome the aforementioned problems. It is another object of the present invention to provide an electrostatic actuator having a durable hydrophobic film, and to provide a manufacturing method therefor. It is yet a further object of the present invention to provide an electrostatic actuator comprising a hydrophobic film that can be deposited on the surfaces of opposing electrode members, which are displaceable relative to each other by an electrostatic force, even when the gap between the opposing electrode members is narrow, and to provide a manufacturing method therefor.

SUMMARY OF THE INVENTION

In accordance with embodiments of the invention, an electrostatic actuator is provided comprising first and second electrode members having respective first and second surfaces opposing each other with a gap disposed therebetween. The actuator further includes a driver for displacing the opposing electrode members relative to each other by producing an electrostatic force therebetween. A hydrophobic film is formed on at least one of the first and second surfaces such that the gap therebetween is sealed airtight. Generally, the hydrophobic film may be formed from an organosilicate compound having a hydrophobic functional group and the ability to react with a hydroxyl group. More preferably, the hydrophobic film is formed from a compound having the functional group $R_3$—Si—X, where R is from the alkyl group and may be, for example, methyl or ethyl. Specific compounds from which the film may be formed include hexamethyldisilazane (HMDS), hexaethyldisilazane, trimethylchlorosilane, triethylchlorosilane, trimethyaminosilane or triethyaminosilane. The preferred compound is HMDS.

The present invention may also be embodied in a method for manufacturing an electrostatic actuator having a first electrode member having a first surface and a second electrode member having a second surface opposing the first surface with a gap disposed therebetween, a driver for displacing the first and second electrodes relative to each other by producing an electrostatic force therebetween, and a hydrophobic film formed on at least one of the first and second surfaces. The method comprises the steps of: depositing a hydrophobic film on at least one of the first and second surfaces; and sealing airtight the gap between the first and second opposing surfaces so that the hydrophobic film is deposited stably on at least one of the first and second surfaces. The hydrophobic film may be formed from one of the compounds stated above, with HMDS being the preferred compound.

This hydrophobic film, formed from a compound in accordance with the present invention, is more durable than a hydrophobic film of PFDA. Furthermore, molecules of such compound are small, and can therefore be deposited on one or both of the opposing surfaces even when the gap between them is narrow.

The inventors of the present invention investigated the durability of an HMDS hydrophobic film (HMDS film) formed on the opposing surfaces when the HMDS film was exposed to the air immediately after deposition. As shown in FIG. 7, it was found that durability drops sharply immediately after exposure, and then settles to a specific level after several minutes. If then left exposed for several days, durability gradually recovers. More specifically, when the gap between the opposing electrode members is sealed during period B in FIG. 7, and charging/discharging of the capacitor formed by the opposing electrode members is repeated four to five million times, a gelatinous substance (foreign matter) is formed in the gap between the opposing electrode members, and operating the actuator becomes difficult. The earlier this gap is sealed, however, the longer it takes for this gelatinous substance to appear (period A). More specifically, the greater the concentration of HMDS in the gap, the more difficult it becomes for this gelatinous substance to appear in the gap. On the other hand, creation of this gelatinous substance also becomes more difficult when the time until the gap is sealed with respect to the surrounding air exceeds a specific time (period C).

This unique phenomenon suggests that a surplus of HMDS in the gap facilitates the occurrence of this gelatinous substance as the charging/discharging of the electrostatic actuator is repeated, but that sealing an extreme surplus of HMDS in the gap conversely suppresses the occurrence of the gelatinous substance. In addition, if the delay until the gap is sealed exceeds a certain time, excess HMDS is eliminated by hydrolysis, and the surplus HMDS that is a source of foreign matter is thought to be eliminated.

These experimental results show that a durable hydrophobic film can be obtained after forming an HMDS film on the opposing surfaces by either (1) sealing the gap in which the HMDS is deposited while the HMDS concentration in the gap is still above a particular level, or (2) sealing the gap after leaving it exposed to the air for a plurality of days.

The present inventors conducted a further study with electrostatic actuators manufactured by method (1) above, that is, sealing the gap to air while the HMDS concentration therein was above a particular level. These studies confirmed that the durability of the hydrophobic film is improved to a level suitable for practical use if the gap is sealed with respect to the surrounding air while the HMDS concentration is 0.3% or greater. A hydrophobic film of sufficient practical durability can also be achieved when the gap is sealed while the HMDS concentration is 0.8% or greater. It was also confirmed that the sealing step can be performed at room temperature and atmospheric pressure.

The deposition step can also be achieved by simply exposing the opposing electrode members to an atmosphere of gasified HMDS at atmospheric pressure until a predefined concentration is obtained. After an HMDS film is thus formed, the gap between the opposing electrode members is sealed while they are kept in the HMDS atmosphere. By sealing the gap while in the HMDS atmosphere, the HMDS concentration in the gap can be reliably maintained above a specific level.

In further studies using electrostatic actuators manufactured by method (2) above, that is, sealing the gap after exposing the opposing electrode members to air for a plurality of days, it was found that moisture is preferably actively supplied during the exposure period. More specifically, leaving the opposing electrode members exposed to a moisture-rich atmosphere promotes HMDS hydrolysis, thereby more quickly eliminating the surplus HMDS that contributes to the production of foreign matter, and forming a stable hydrophobic film.

It should be noted that whether the gap between the opposing electrode members is sealed immediately or after a period of days in accordance with methods (1) and (2) above, a pretreatment step for reducing the moisture content in the gap preferably precedes the deposition step. More specifically, the manufacturing method for an electrostatic actuator according to the present invention preferably comprises a drying step for reducing the moisture content in the gap before the deposition step. This drying step helps stabilize the HMDS deposition, and can avoid variations in the HMDS deposition during the sealing step.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

Preferred embodiments of the electrostatic actuator according to the present invention are described below, with reference to the accompanying figures, as applied to an ink jet head as one application of such an electrostatic actuator.

Figure 1:
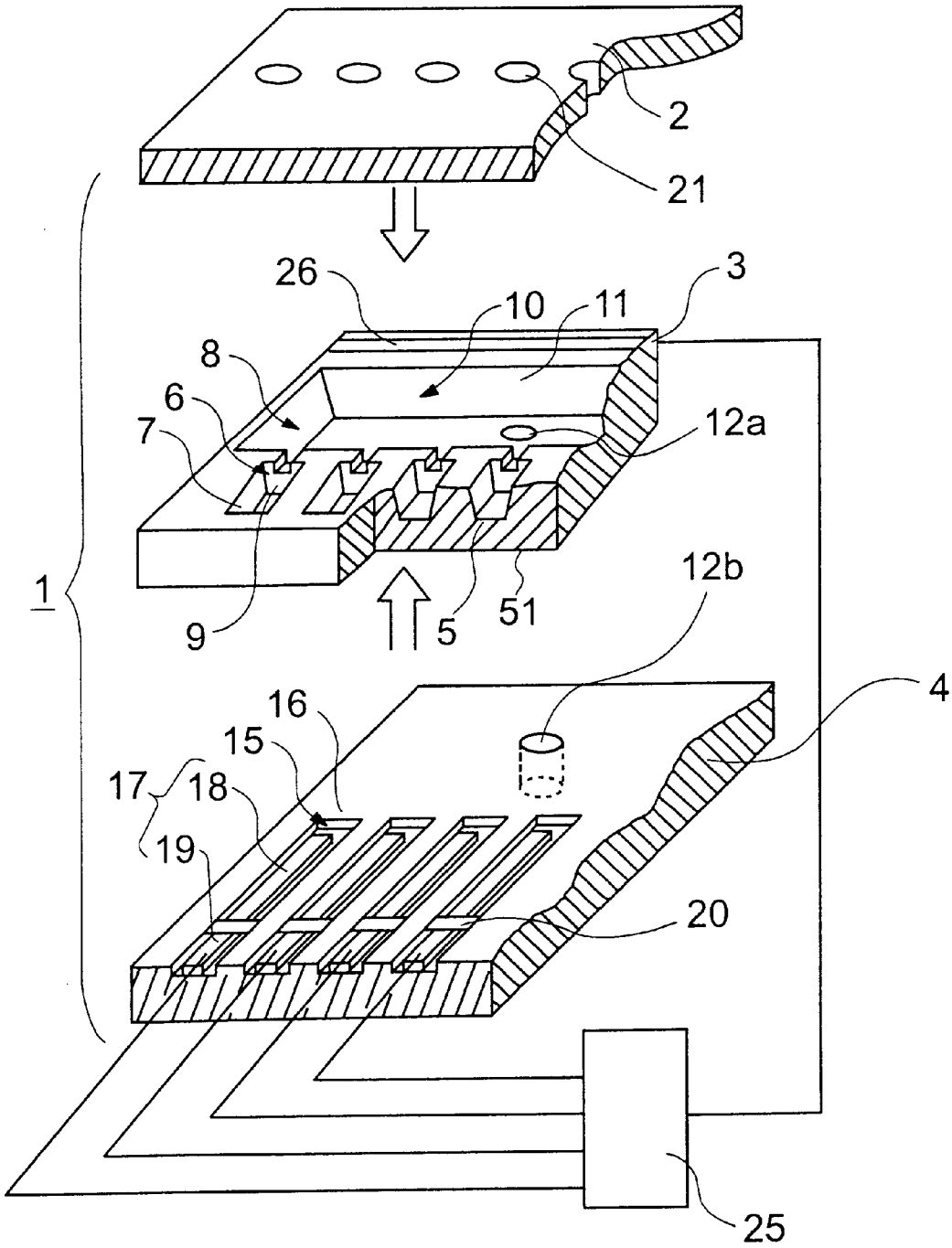
FIG. 1 is an exploded perspective partial view of an ink jet head to which the present invention is applied.

FIG. 1 is an exploded perspective partial view of an ink jet head 1 which employs electrostatically driven actuators for ink drop injection. The ink jet head in this embodiment is a face nozzle type ink jet head whereby ink drops are ejected from ink nozzles formed on the top surface of the ink jet head. The ink jet head 1 is a three-layer construction with a nozzle plate 2 on the top, a glass substrate 4 at the bottom and an intermediate cavity plate 3 in between.

The material from which the cavity plate 3 is made, although not critical to the present invention, is preferably a silicon substrate. A recess 11, a plurality of pairs of a recess 7, and a narrow channel 9 are formed by etching the surface of the cavity plate 3. The bottom of cavity plate 3 is smoothed by mirror polishing.

The nozzle plate 2 is also preferably made from a silicon substrate. When the nozzle plate 2 is bonded to the top of the intermediate cavity plate 3, recess 11, as well as recesses 7 and 9, are covered. As such, recess 11 becomes an ink reservoir 10, recesses 7 become separate ink chambers 6 and channels 9 become ink supply openings 8. Each ink chamber 6 is connected at its back side via a respective one of ink supply openings 8 to ink reservoir 10 from which ink is supplied to each ink chamber 6. A plurality of ink nozzles 21, each opening into a corresponding one of ink chambers 6, is formed through nozzle plate 2.

The glass substrate 4 bonded to the bottom of cavity plate 3 is preferably a borosilicate glass substrate having a thermal expansion coefficient close to that of silicon. A plurality of recesses 16 are formed in the surface of glass substrate 4 facing cavity plate 3. Each recess 16 is registered with one of the ink chambers 6 so that, in the bonded state, a respective vibration chamber or actuator cavity 15 is formed between the bottom of each ink chamber and the bottom of the corresponding recess 16.

A hole 12*a* is disposed in the bottom of ink recess 11, and a corresponding hole 12*b* is formed through glass substrate 4 such that after glass substrate 4 is bonded to cavity plate 3, an ink supply hole 12 is formed from holes 12*a* and 12*b*. A supply tube not shown in the figures is connected between ink supply hole 12 and an ink tank, which also is not shown in the figures, for supplying ink to ink reservoir 10. The ink supplied through ink supply hole 12 is supplied via the individual ink supply openings 8 to the separate ink chambers 6.

An electrostatic actuator is provided for each of the ink chambers 6. Its purpose is to temporarily increase the pressure inside the respective ink chamber 6 thereby to eject an ink droplet through the corresponding nozzle 21. The electrostatic actuator comprises two electrode members opposing each other via a small gap. A first electrode member is formed as a deflectable diaphragm 5. In the ink jet head 1 described above, the bottom of the ink chamber 6 forms the diaphragm 5. The second electrode member is formed by the bottom of the corresponding recess 16 on which an electrode is provided. In the present embodiment, the cavity plate 3 is electrically conductive so the diaphragm 5 can also be called an electrode. Since the diaphragms 5 of all ink chambers 6 are electrically connected to each other, the diaphragm 5 will also be referred to as the "common electrode" and the electrode on the bottom of recess 16 as the "segment electrode" of the actuator. The segment electrode 18 is part of a respective electrode part 17 comprising this segment electrode 18 made from ITO and a terminal portion 19.

When glass substrate 4 is bonded to cavity plate 3, each diaphragm 5 (i.e., the bottom of each ink chamber 6) and the corresponding segment electrode 18 are separated by an extremely narrow gap within the respective actuator cavity 15. This actuator cavity 15 is sealed by a sealant 20 disposed between cavity plate 3 and glass substrate 4. Note that with the segment electrode 18 on the bottom of recess 16 the actuator cavity 15 is substantially identical with the gap between the two electrode members, i.e., diaphragm 5 and the segment electrode 18.

Figure 2:
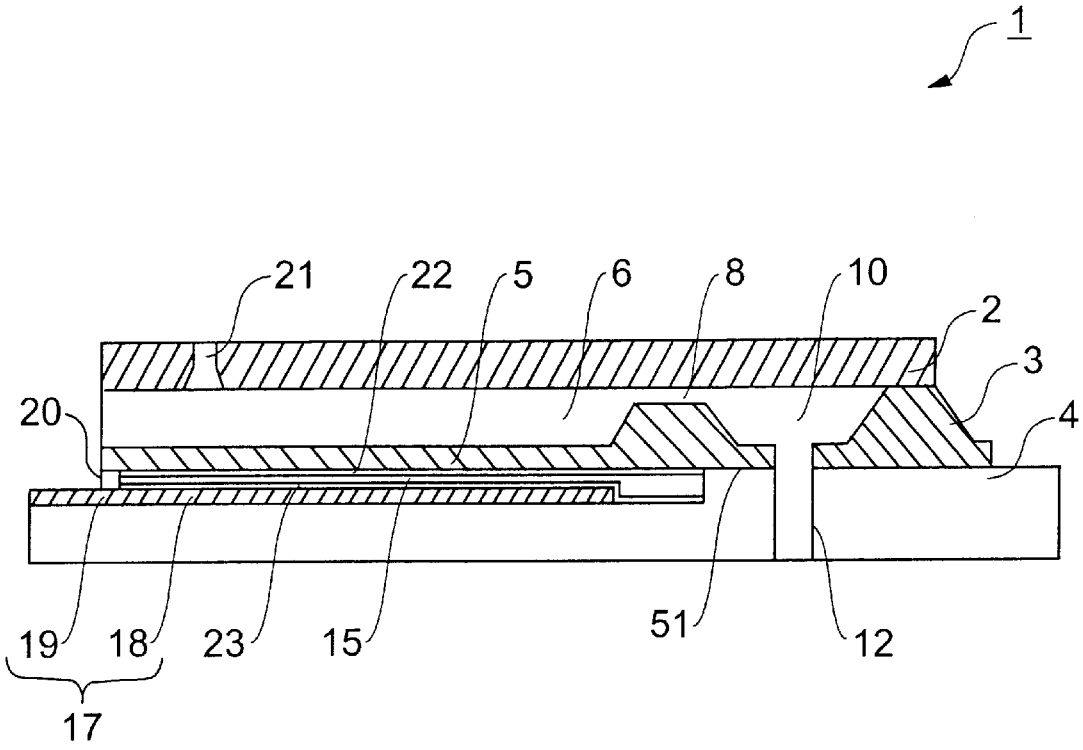
FIG. 2 is a lateral cross sectional view of the ink jet head shown in FIG. 1.
Figure 3:
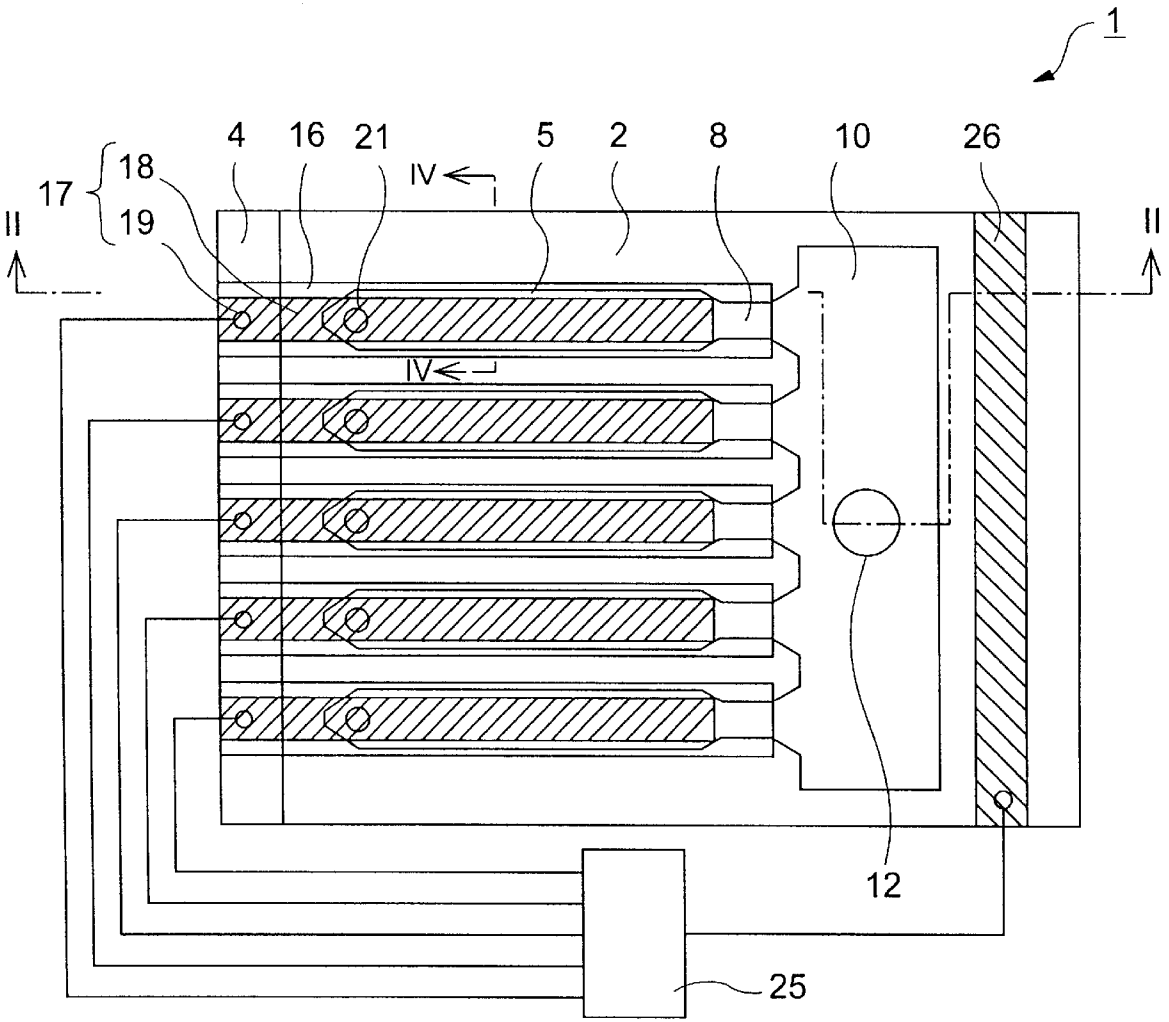
FIG. 3 is a plan view of the ink jet head shown in FIG. 1.
Figure 4:
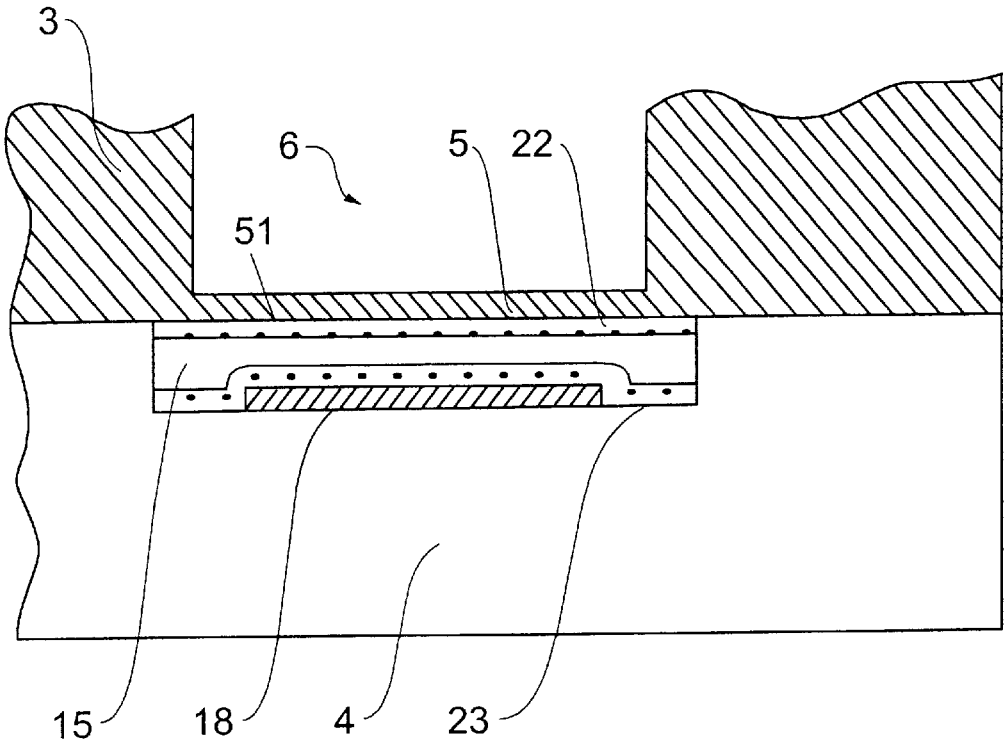
FIG. 4 is an enlarged partial cross sectional view of the ink jet head shown in FIG. 1 and taken along line IV—IV in FIG. 3.

Diaphragm 5 is a thin-wall member that is elastically deformable in the direction perpendicular to its surface, that is, in the vertical direction as seen in FIG. 2. The bottom surface 51 of the diaphragm 5 is coated with a hydrophobic film 22 of hexamethyldisilazane (HMDS). A hydrophobic film 23 of hexamethyldisilazane (HMDS) is also formed on the top surface of the segment electrode 18. Films 22 and 23 may be referred to as HMDS films.

A voltage applying means 25 is connected to apply a drive voltage across each diaphragm 5 and the associated segment electrode 18. One of a plurality of second outputs of voltage applying means 25 is connected to the terminal portion 19 of a respective electrode part 17, and another output is connected to a common electrode terminal 26 formed on cavity plate 3. In order to decrease the electrical resistance between common electrode terminal 26 and each diaphragm 5, a thin film of gold or other conductive material may be formed on one surface of cavity plate 3 by means of vapor deposition, sputtering, or other method. Anodic bonding is used for connecting cavity plate 3 and glass substrate 4 in the present embodiment, and such conductive film is therefore formed on the surface of cavity plate 3 on which the ink flow paths are formed. Such conductive film may also be employed when an insulating material is used for the intermediate substrate.

When a drive voltage is applied from voltage applying means 25 across the opposing electrodes 5 and 18 of an electrostatic actuator in ink jet head 1 thus comprised, a Coulomb force is produced by the charge accumulating on the opposing electrodes 5 and 18, which causes diaphragm 5 to be directed from its initial or stationary position toward segment electrode 18 thereby increasing the volume of the respective ink chamber 6. When the drive voltage is then discontinued (i.e., the common electrode 26 and the segment electrode 18 are shorted), the charge stored on the opposing electrodes 5 and 18 is discharged, and diaphragm 5 is returned to its stationary position by its inherent elastic restoring force, thus rapidly reducing the volume of the ink chamber 6. The resulting pressure change within the ink chamber 6 causes part of the ink contained therein to be ejected through the associated ink nozzle 21 onto a recording medium (not shown).

Note that the ink preferably used by ink jet head 1 explained above is prepared by dissolving or dispersing a dye or pigment with a surface active agent such as ethylene glycol in water, alcohol, toluene or other primary solvent. A hot melt ink can also be used if a heater is further provided for ink jet head 1.

Manufacturing Method

A preferred method for manufacturing ink jet head 1 with the electrostatic actuators according to the present invention is described below with reference to FIG. 5.

Figure 5:
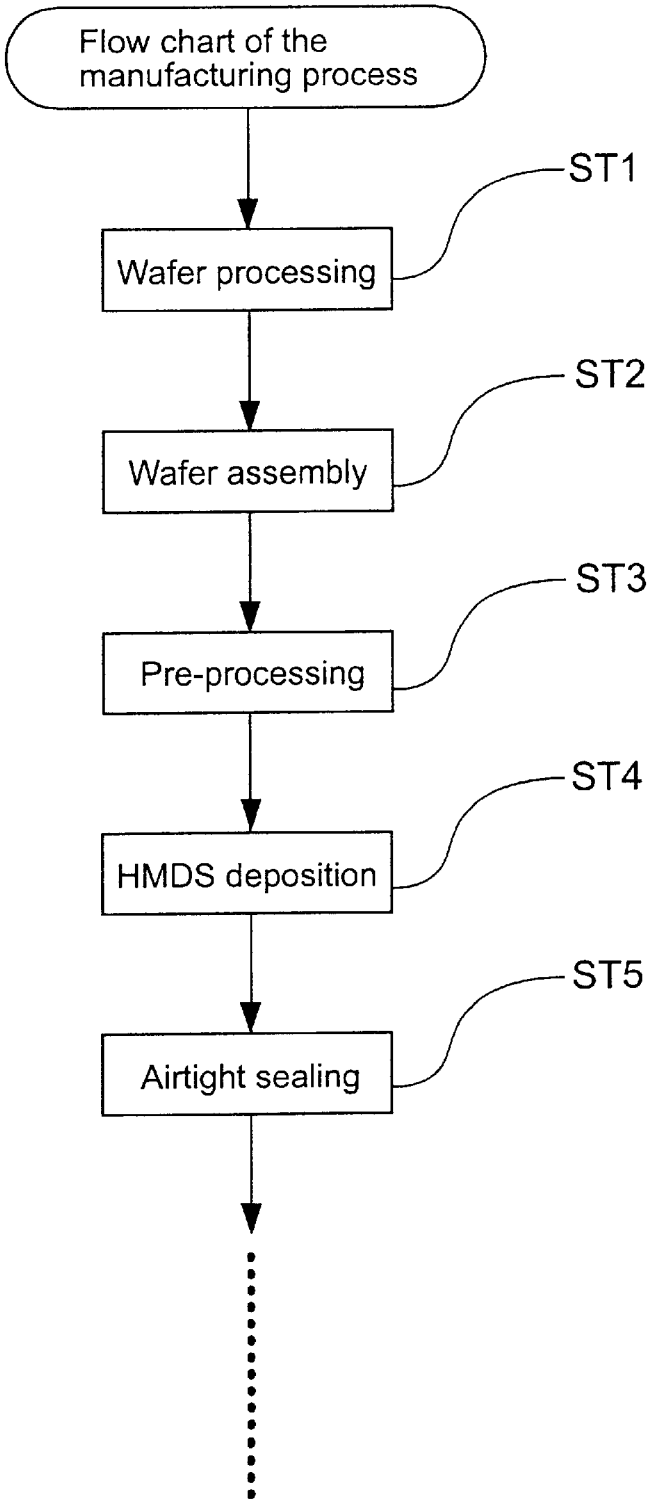
FIG. 5 is a simplified flow chart of a method for manufacturing an ink jet head 1 as shown in FIG. 1.

As shown in FIG. 5, this manufacturing process starts by processing the cavity plate 3, nozzle plate 2 and glass substrate 4 wafers (step ST1). The three wafers are then assembled (bonded) in step ST2 to form the ink jet head 1. It should be noted that at this time the HMDS film is not yet formed on the bottom surface 51 of diaphragms 5 nor on the surfaces of segment electrodes 18. Furthermore, the actuator cavities 15 are not sealed yet.

The ink jet head 1 is then preprocessed by a drying process in step ST3 to eliminate or reduce to the lowest possible level, moisture on the opposing surfaces on which the HMDS film is to be formed. This can be accomplished by, for example, exposing ink jet head 1 to a dry air stream in a processing chamber. This preprocessing step helps stabilize the HMDS deposition state by eliminating or reducing excess moisture on the bottom surface 51 of diaphragms 5 and on the surfaces of segment electrodes 18, thereby avoiding variations in the deposition state of HMDS in the next process step.

This preprocessing step can also be accomplished by a vacuum heating process in which the ink jet head 1 is heated in a vacuum chamber, a process whereby the ink jet head 1 is placed in a processing chamber which is alternately switched between vacuum and nitrogen environments, or a process combining these methods.

HMDS films 22 and 23 are then deposited on the bottom surface 51 of diaphragms 5 and on the surfaces of segment electrodes 18 in the HMDS deposition step (ST4). This can be accomplished by, for example, placing a container of HMDS in the preprocessing chamber, stopping the supply of dry air, returning the chamber to room temperature, normal humidity (45%–85% relative humidity) and atmospheric pressure, and maintaining this environment until the actuator cavities 15 (actually formed by the gap between the diaphragm 5 and the segment electrode 18) are sufficiently penetrated by HMDS diffusion. In a test, sufficient HMDS diffusion required approximately twenty hours in the preferred embodiment of the invention with an HMDS concentration of approximately 0.3% or greater in the processing chamber. This deposition process results in hydrophobic HMDS films 22 and 23 being deposited on the bottom surface 51 of diaphragms 5 and on the surfaces of segment electrodes 18.

Figure 6:
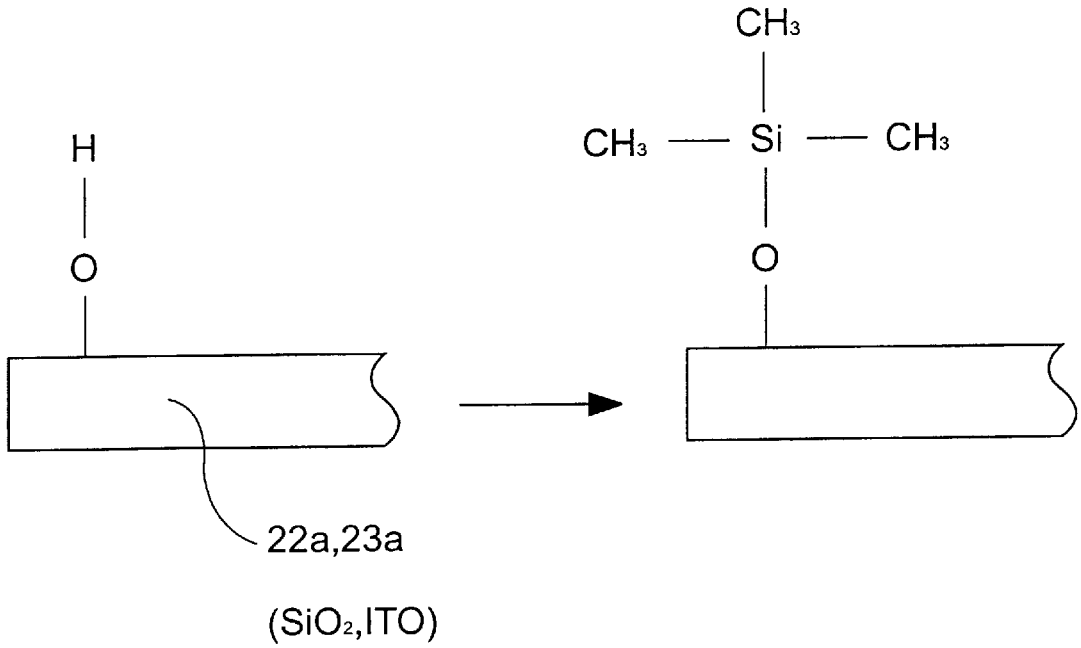
FIG. 6 is an illustration of a hexamethyldisilazane (HMDS) hydrophobic film formed by the manufacturing method of the invention.

The molecular bonding of the HMDS layers 22*a* and 23*a* formed on the bottom surface 51 of a silicon diaphragm 5 and on an ITO segment electrode 18 is illustrated in FIG. 6 which shows that an OH group is replaced by an $OSi(CH_3)_3$ group on each surface.

Without removing the ink jet head 1 from the processing chamber, the actuator cavities 15 are sealed airtight in the sealing step (ST5). The concentration of HMDS in the sealed actuator cavities 15 at this time is approximately 0.3% or greater.

Figure 7:
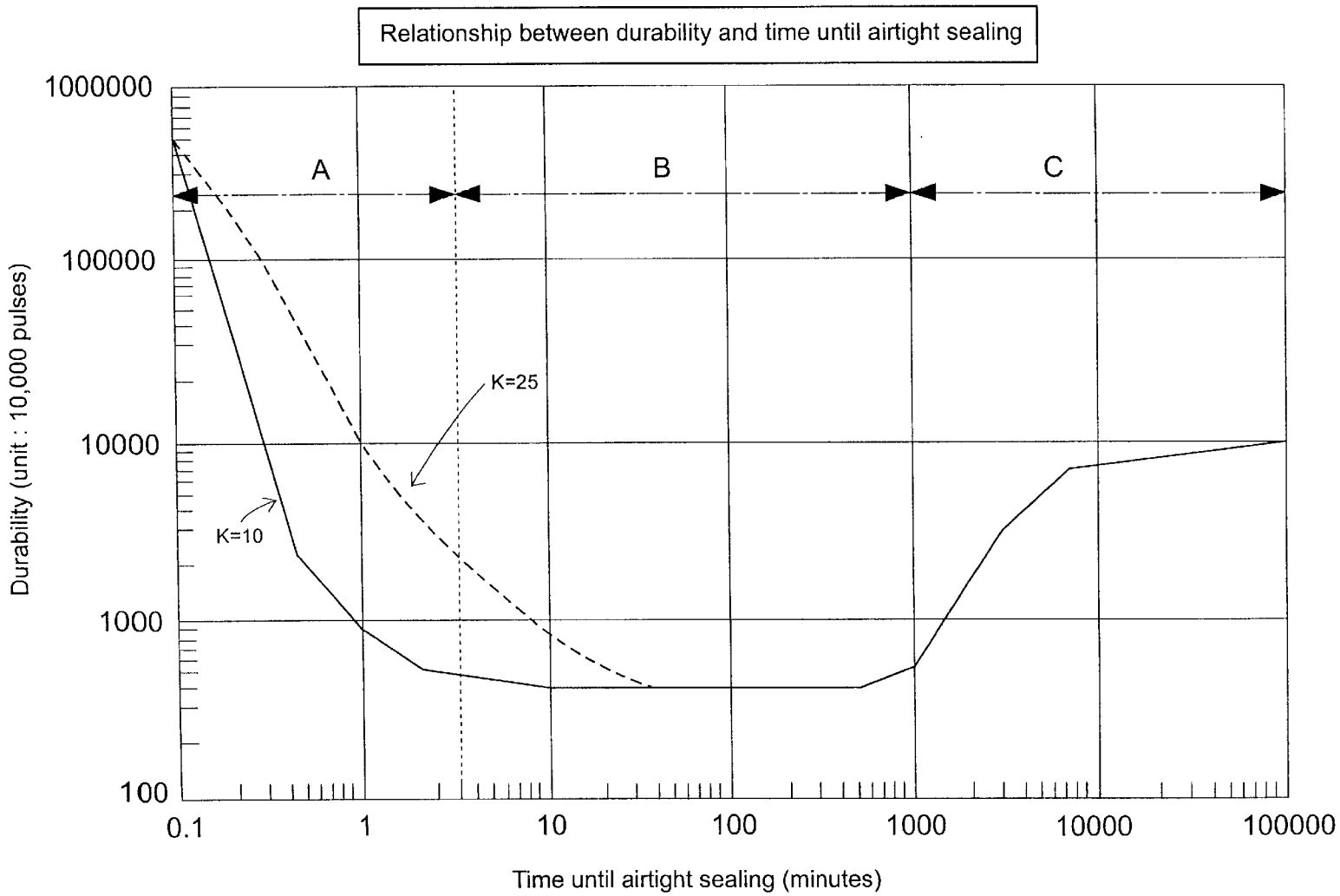
FIG. 7 is a graph of the relationship between the durability of a hydrophobic film and the delay until gap sealing when the gap is exposed to air immediately after hydrophobic film formation.

FIG. 7 is a graph of the relationship between the durability of HMDS films 22 and 23 and the time during which the ink jet head 1 is exposed to air immediately after formation of the hydrophobic films 22 and 23 (i.e., the time until the actuator cavities 15 are sealed). It should be noted that the curve shown in FIG. 7 was obtained using an HMDS concentration inside the processing chamber of 0.8% or greater during the sealing process. Note further that the durability was measured as the number of deflection cycles of diaphragm 5 the films withstood without separating.

As shown by the downward trending curve in period A in FIG. 7, the durability of HMDS films 22 and 23 drops sharply immediately after removal from the processing chamber, that is, when the ink jet head 1 is removed from the processing chamber and HMDS films 22 and 23 are exposed to air before the actuator cavities 15 are sealed. Durability then stabilizes at a certain level after some minutes, and remains stable at substantially this level throughout period B. Durability then gradually recovers after a plurality of days as indicated by the upward trending curve in period C. It should be further noted, however, that the durability of HMDS films 22 and 23 in period C remains lower than the durability immediately after film formation in period A.

In the manufacturing method of the present invention, the actuator cavities 15 are sealed while the HMDS concentration therein is approximately 0.3% or greater. The actuator cavities 15 are therefore essentially sealed immediately after forming the HMDS hydrophobic films 22 and 23, that is, in the downward trending period A of FIG. 7. The durability of HMDS films 22 and 23 formed on the surface of diaphragms 5 and on the surfaces of segment electrodes 18 is therefore substantially the same as the film durability immediately after the hydrophobic films 22 and 23 are formed.

Figure 8:
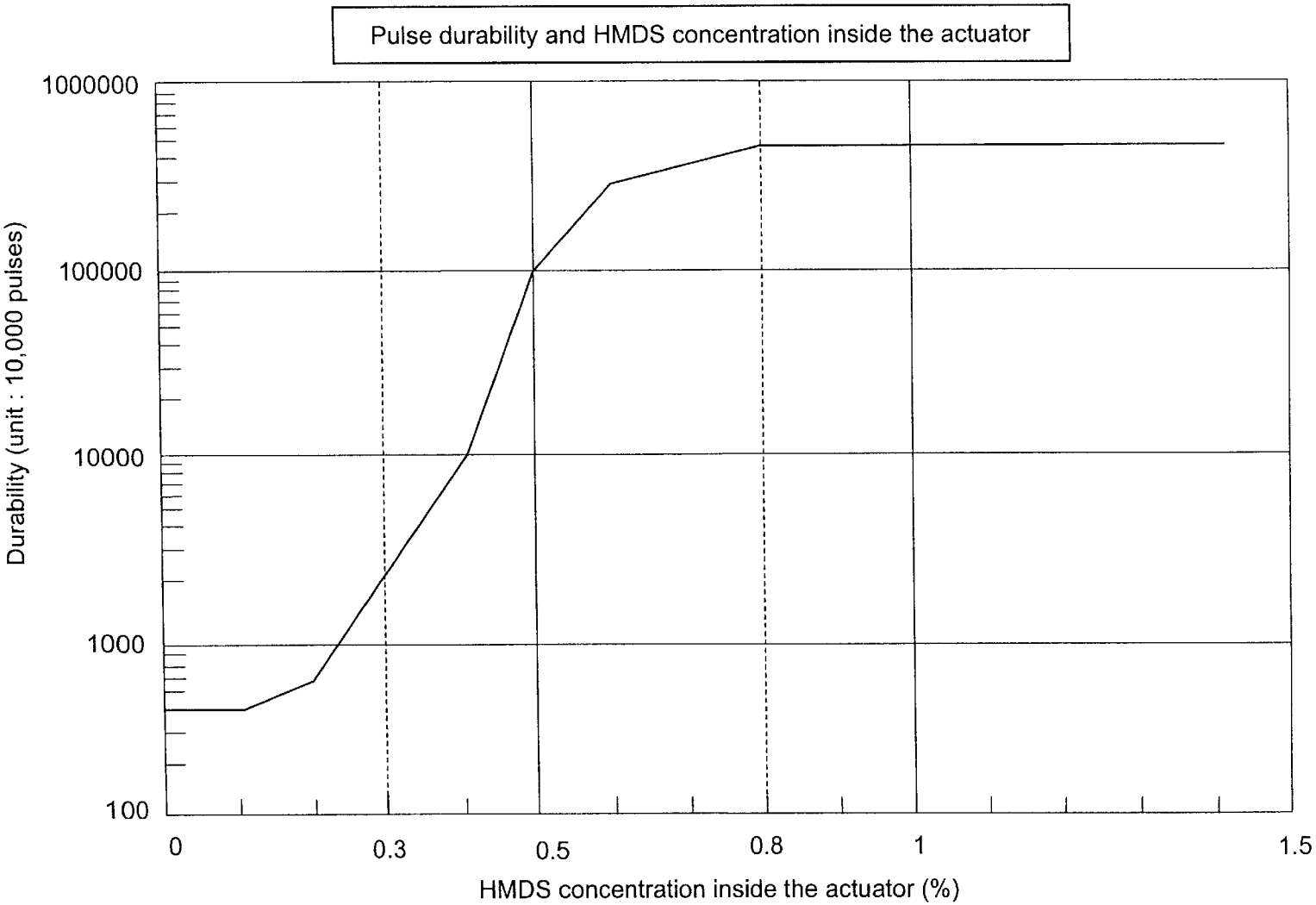
FIG. 8 is a graph of the relationship between the durability of a hydrophobic film of HMDS and the HMDS concentration in the gap obtained when the gap is sealed after removal from the HMDS deposition chamber within the period of the downward trending curve in FIG. 7.

FIG. 8 is a graph of the relationship between the durability of HMDS films 22 and 23 and HMDS concentration in the actuator cavities 15 when they are sealed within the downward trending period A shown in FIG. 7. As will be seen from this graph, because ink jet head 1 is sealed so that the HMDS concentration in actuator cavities 15 is 0.3% or greater, the durability of HMDS films 22 and 23 is a minimum of approximately 20 million cycles. This means that HMDS films with a durability comparable to or greater than that obtained when actuator cavities 15 are sealed a period of days after forming HMDS films 22 and 23 can be obtained. Furthermore, as also shown in FIG. 8, HMDS films 22 and 23 with durability sufficient to withstand 100 million cycles or more can be obtained when the HMDS concentration in actuator cavities 15 is approximately 0.4% or greater.

Note further that the durability of HMDS films 22 and 23 continues to rise as the HMDS concentration in actuator cavities 15 increases until at an HMDS concentration of approximately 0.8% the durability is saturated at approximately five billion cycles.

Therefore, to compensate for control variations in the HMDS concentration in the processing chamber, the HMDS concentration in the processing chamber is preferably set to approximately 1.0% to 1.1%, and actuator cavities 15 are preferably sealed while in the processing chamber. As also described above, it is not necessary to wait a period of days after HMDS film formation in order to assure sufficient durability in the HMDS hydrophobic films 22 and 23. As a result, the method of the present invention has the further advantage of permitting the manufacture of electrostatic actuators in a short period of time suitable for mass production.

Note further that the sealing process can also be accomplished after removing ink jet head 1 from the processing chamber. However, because the durability of HMDS films 22 and 23 drops rapidly when ink jet head 1 is removed from the processing chamber as shown in FIG. 7, it is necessary to seal the actuator cavities 15 of ink jet head 1 within approximately the first three minutes immediately after removal from the processing chamber assuming the parameters shown in FIG. 7.

It must be further noted that during the HMDS deposition process shown as step ST4 in FIG. 5 HMDS may enter through nozzles 21 and/or ink supply hole 12 and form an HMDS film on surfaces of the ink flow path formed by cavity plate 3 and nozzle plate 2. The resulting hydrophobicity of those surfaces degrades the ability of the ink jet head 1 to expel air bubbles from the ink path. This problem can be resolved, however, by removing the HMDS film from the ink path surfaces by means of an RCA cleaning process (cleaning with a solution of ammonia and hydrogen peroxide) following the sealing process of step ST5.

Manufacturing Method According to an Alternative Embodiment

Figure 9:
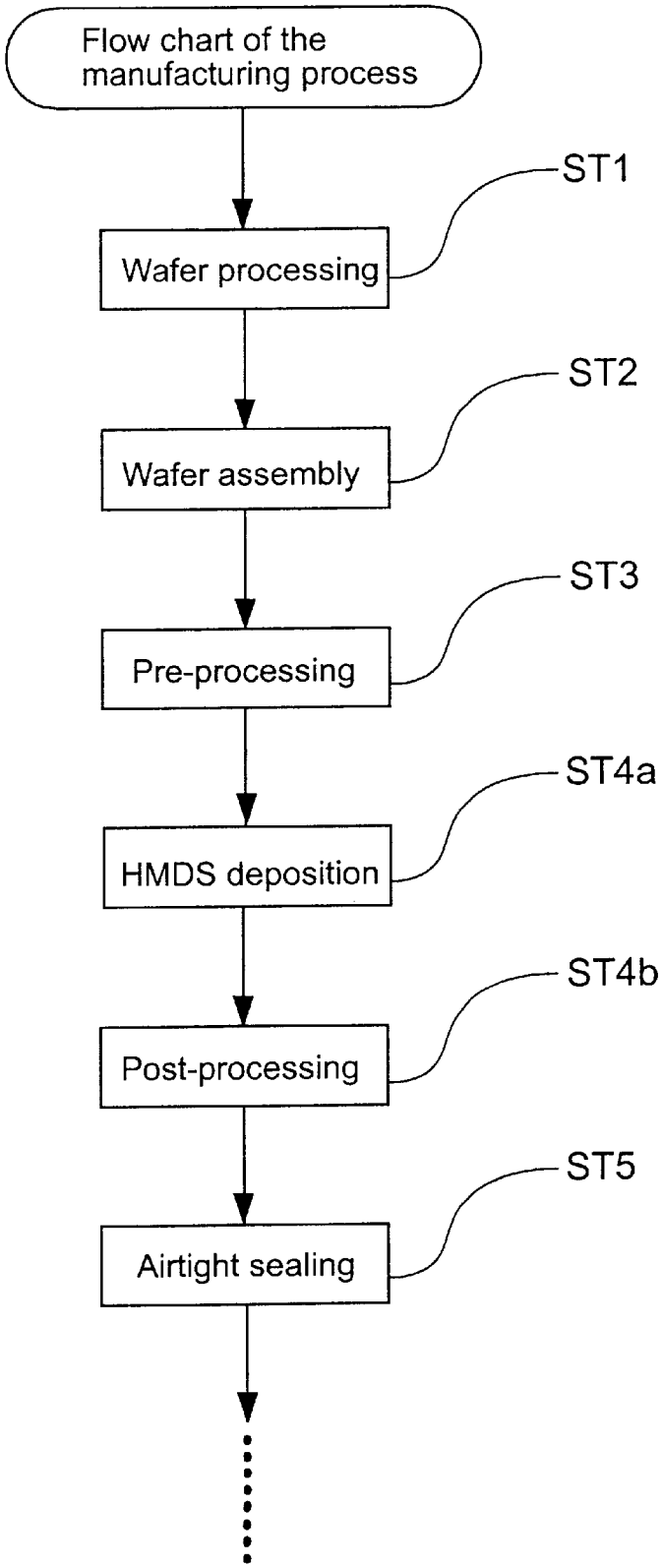
FIG. 9 is a simplified flow chart of a manufacturing method according to an alternative embodiment of the present invention for an ink jet head as shown in FIG. 1.

The manufacturing method of the present invention described above seals the actuator cavity 15 while the HMDS concentration therein is at a particular level using the characteristics of period A in FIG. 7. Sealing the actuator cavity 15 while the HMDS concentration is maintained at such a particular level can be difficult, however, depending upon the configuration of the electrostatic actuator (ink jet head) and manufacturing equipment-related considerations. In such cases durability can be improved by actively utilizing the characteristics shown in period C of FIG. 7 after the deposition process. A manufacturing method according to an alternative embodiment of the invention thus comprised is described next with reference to the flow chart in FIG. 9. Note that identical steps in the flow charts in FIG. 5 and FIG. 9 are identified by like reference numerals, and further description thereof is thus omitted below.

Steps ST1 and ST2 are the same as those in FIG. 5, resulting in an assembled ink jet head 1 in which an HMDS film is not yet formed on the surface of diaphragms 5 nor on segment electrodes 18. The same process is also used in step ST3 to eliminate or reduce moisture from those surfaces.

In the HMDS deposition process of step ST4, however, HMDS can be deposited on the bottom surface 51 of diaphragms 5 and on the surfaces of segment electrodes 18 using either a gas or liquid phase process. Such a gas phase process can be accomplished by a method of depositing HMDS at atmospheric pressure or by a vacuum deposition method. While the preceding embodiment deposits HMDS at atmospheric air pressure, the present embodiment does not seal the actuator cavity immediately after HMDS deposition, and is therefore not limited to depositing HMDS at atmospheric (normal) pressure. For example, a hydrophobic film of HMDS can be formed on the bottom surface 51 of diaphragms 5 and on the surfaces of segment electrodes 18 by maintaining ink jet head 1 in an HMDS atmosphere at between 20° C. and 200° C. for a period between approximately 5 to 150 minutes at a vacuum of 10 Torr (1.3 kPa) or greater.

A liquid phase method deposits HMDS by immersing the ink jet head 1 in HMDS. This method relies upon capillary action for HMDS to enter the actuator cavities 15 defining gap G and be deposited on the bottom surface 51 of diaphragms 5 and on the surfaces of segment electrodes 18. In an exemplary embodiment of this method, ink jet head 1 and HMDS are held at room temperature, and ink jet head 1 is immersed in an HMDS solution for five minutes or longer. Excess HMDS is then removed from gap G by exposing the ink jet head 1 to an atmosphere of 20° C. to 200° C. This method offers the advantage of depositing HMDS in a short time.

Post-processing steps (ST4*b*) include a moisture imparting and exposure process as explained below. Note that these methods can be used either independently or in combination.

A moisture imparting process removes excess HMDS from the HMDS film by supplying moisture to promote hydrolysis. Supplying moisture to the HMDS film suppresses the occurrence of foreign matter as a result of HMDS film aging, and has been confirmed to improve the stability of the HMDS film. In an exemplary embodiment of this process, the ink jet head 1 is exposed after HMDS deposition to an atmosphere between 20° C. to 200° C. with 20% to 100% relative humidity. This moisture imparting process can be initiated after the HMDS deposition process is completed, or while the HMDS deposition process is still in progress. If moisture imparting is initiated while the HMDS deposition process is still in progress, the ink jet head 1 is placed in an atmosphere of only HMDS at the beginning of HMDS deposition, and moisture is then added to the HMDS atmosphere at some point during the HMDS deposition.

In the exposure process, the ink jet head 1 is placed and left after HMDS deposition in an atmosphere between 20° C. to 200° C. at a relative humidity of 45% to 85%, preferably about 60%, for a period from a day or two to approximately one week. This process promotes stabilization of HMDS bonding, suppresses the occurrence of foreign matter as a result of HMDS film aging, and improves film stability.

The actuator cavities or gap 15 are sealed (ST5) after these processes are completed to complete the manufacturing process.

Actuator Cavity Sealing Structure in an Ink Jet Head

The structure of a seal for sealing the actuator cavity or gap in an ink jet head according to the present invention is described next with reference to FIG. 7, FIG. 10, and FIG. 11.

As described above, the actuator cavity or gap between the opposing electrodes of the actuator is preferably sealed while the HMDS concentration high. It is therefore preferable to use a process in which the gap is sealed inside the processing chamber for HMDS deposition, but this process is accompanied by the following problems. Specifically, sealing the gap using a sealant, and particularly using an epoxy adhesive, inside the HMDS deposition processing chamber is not an easy task. In addition, contamination of the processing chamber with non-HMDS components from the adhesive is not desirable because of quality control problems.

It therefore follows that removing the electrostatic actuator after exposure to HMDS in the processing chamber for a specific period, and then quickly sealing the gap immediately after removal, is better suited to mass manufacturing electrostatic actuators.

As previously described with reference to FIG. 7, the HMDS concentration in the gap drops immediately after removal from the processing chamber, and the durability drops if there is much of a delay between removal and sealing the gap. Referring again to FIG. 7, the slope of the curve in period A represents the rate of the drop in HMDS concentration in the gap after the electrostatic actuator is removed from the chamber. The faster this rate, that is, the steeper the slope of this curve, the sooner the gap must be sealed.

The present embodiment relates to a structure for sealing the gap 15 between opposing electrode members 5 and 18, and relates particularly to a structure for suppressing the drop in HMDS concentration in the gap 15 in the period between removal from the chamber and sealing.

Figure 10:
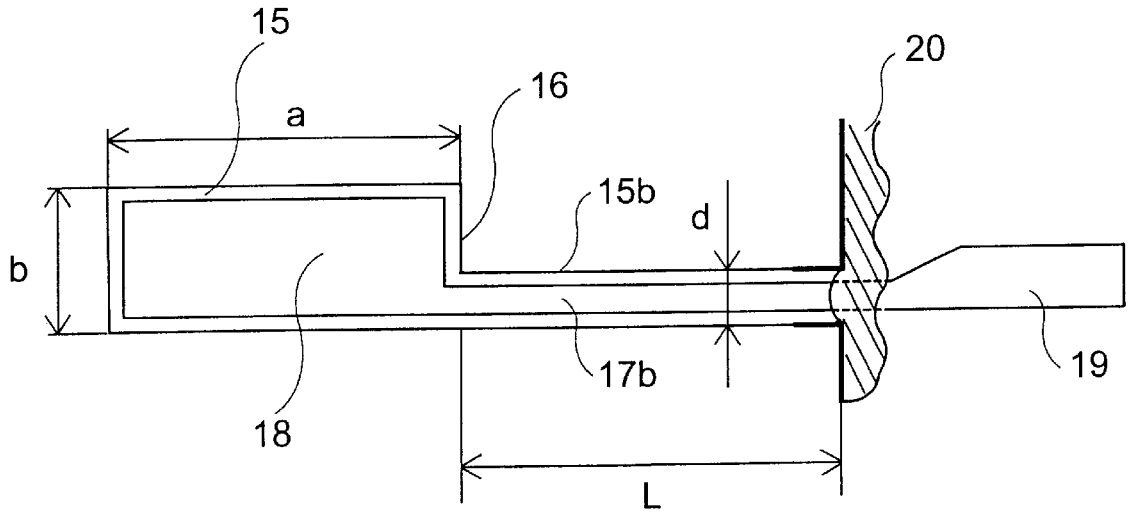
FIG. 10 is a plan view of the seal area of the gap between opposing members in the ink jet head shown in FIG. 1.

FIG. 10 is a plan view of the seal area of the gap 15 between opposing electrode members 5 and 18 of the ink jet head 1 shown in FIG. 1. As shown in FIG. 10, segment electrode 18 and terminal portion 19 are connected by an interconnect 17*b*. Segment electrode 18 and interconnect 17*b* are formed by vapor deposition of ITO in recess 16 of glass substrate 4.

As shown in FIG. 10, recess 16 is separated into two parts. One part becomes the actuator cavity 15 (when glass substrate 4 has been bonded to cavity plate 3) and has width b and length a, while the other part becomes tube or channel 15*b*, which links actuator cavity 15 to the outside of the ink jet head 1, and has width d and length L. Note that after glass substrate 4 is bonded with cavity plate 3, and HMDS is deposited inside actuator cavity 15, the open end of tube 15*b* is closed by sealant 20.

If V is the volume of actuator cavity 15 such that V=a·b·g, where g is the gap length (the distance between diaphragm 5 and segment electrode 18), and S is the cross sectional area of tube 15*b* such that S=d·g the magnitude of value K expressed by the following equation $$K=V\cdot L/S$$

is related to the speed of the drop in the HMDS concentration in the gap of the electrostatic actuator after removal from the HMDS deposition processing chamber. It was experimentally determined that sufficient durability of HMDS films can be assured in the electrostatic actuator even when the gap is sealed outside the processing chamber if K≧25.

Referring again to FIG. 7, the relationship between the durability and time until the gap is sealed in period A is shown for the two cases of K=10 and K=25 by the solid line segment and the dotted line segment, respectively. As will be seen from the figure, a durability sufficient to withstand approximately 100 million deflection cycles or pulses can be achieved if the gap is sealed within the first minute after removal from the processing chamber when K=25, but when K=10, it is difficult to achieve even a durability of 10 million deflection cycles. Furthermore, the gap must be sealed within approximately 10 seconds after removal from the processing chamber if a durability of 100 million deflection cycles is to be achieved when K=10, a requirement which is incompatible with and substantially impossible to achieve in a mass production environment.

Figure 11:
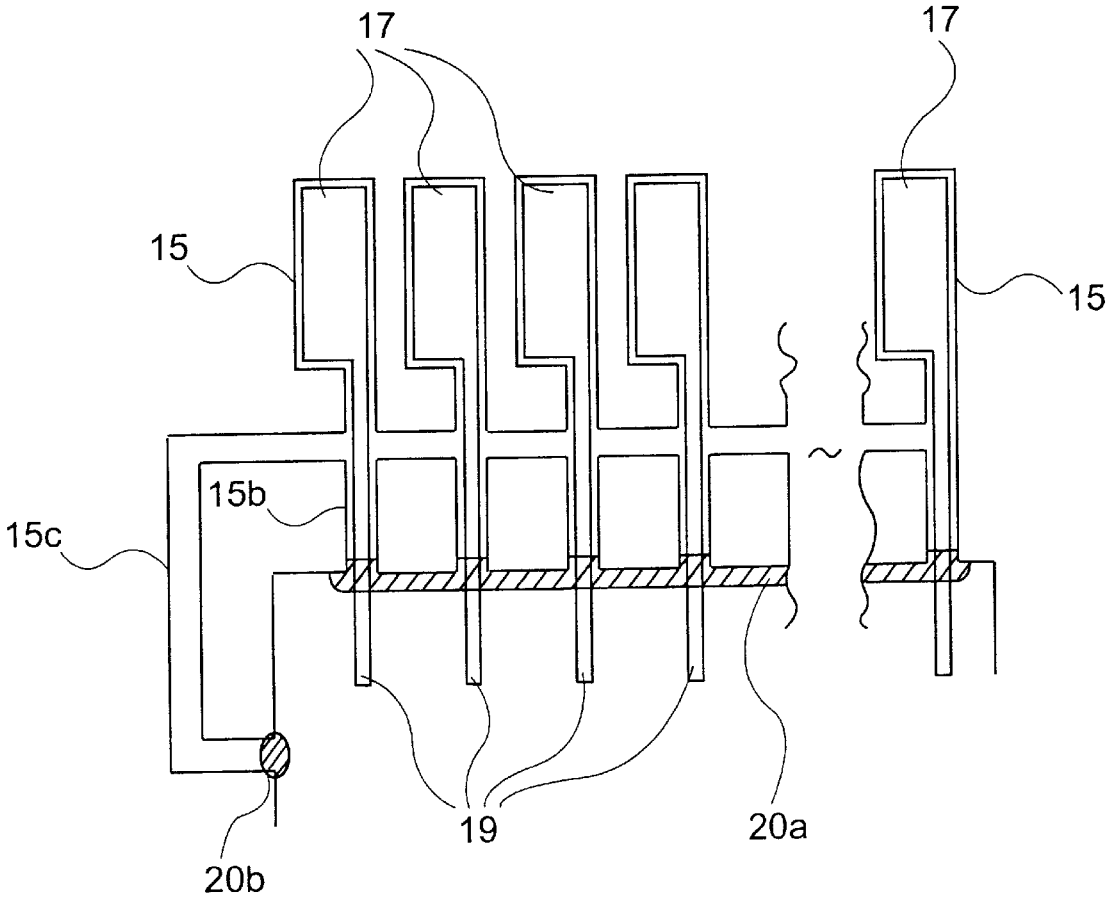
FIG. 11 is a plan view of the seal area of the gap between opposing members of an ink jet head according to an alternative embodiment of the invention.

FIG. 11 is a plan view of a seal area in a gap of an electrostatic actuator according to an alternative embodiment of the present invention. Note that like parts in FIG. 11 and FIG. 10 are identified by like numerals.

Each of a plurality of actuator cavities 15 arranged in series comprise a connection tube 15*b* connecting a respective actuator cavity 15 to a seal 20*a*, and a bypass tube or channel 15*c* connecting all of the tubes 15*b* to each other. A seal 20*b* is also provided at the open end of this bypass tube 15*c*.

An ink jet head comprising electrostatic actuators according to the present embodiment of the invention is manufactured with HMDS sealed in actuator cavities 15 by means of the following process.

First, recesses are formed at specified locations in glass substrate 4 by etching, and electrode 17 is formed at a specified location inside the recesses. This glass substrate 4 and cavity plate 3 in which diaphragms 5 are formed are then anodically bonded together to form actuator cavities 15 and tubes 15*b* and 15*c*. After sealing the open end of each tube 15*b* with seal 20*a*, the ink jet head 1 is placed in a chamber filled with a specific concentration of HMDS, and is left in this environment for a specified period of time. The ink jet head 1 is then removed from the chamber, and the open end of bypass tube 15*c* is sealed with seal 20*b* to cut off the actuator cavities 15 from the outside air with HMDS sealed therein at a specified minimum concentration or greater.

Thus providing a bypass tube 15*c* makes it possible to increase the K value 50 to 60 times compared with a device in which no bypass tube 15*c* is disposed without increasing the area of the actuator or the ink jet head itself. In other words, the drop in HMDS concentration in the gap between opposing electrode members of the electrostatic actuator after removal from the processing chamber can be suppressed.

This method offers the additional advantage of enabling sealing to be completed more quickly because the actuator cavities or gap can be sealed at only one location after the HMDS deposition process, and the area to be sealed is smaller than the area that must be sealed when a bypass tube is not provided.

Other Embodiments

In the embodiments described above, the hydrophobic film is formed after the cavity plate 3 and the glass substrate 4 have been bonded together causing the hydrophobic film to be deposited on both of the opposing surfaces. The desired effect, namely to prevent the opposing surfaces from sticking together, may also be achieved with a hydrophobic film on only one of the two opposing surfaces. As will be appreciated by those skilled in the art, the forming of a hydrophobic film on only one of the opposing surfaces may easily be achieved when the deposition step precedes the bonding step and only one of the surfaces is exposed to the deposition step.

Furthermore, HMDS has been described above as the material for the hydrophobic film. In fact, HMDS is only one member of a class of materials that may be used in accordance with the present invention. The class may be generally defined as organosilicate compounds having a hydrophobic functional group and the ability to react with a hydroxyl group. The class may also be defined as compounds having the functional group $R_3$—Si—X, where R represents an alkyl group such as $CH_3$ or $C_2H_5$ and X represents either halogen, amino group or silylated amine. Other members of the class include hexaethyldisilazane ($(C_2H_5)_3SiNHSi(C_2H_5)_3$), trimethylchlorosilane ($(CH_3)_3SiCl$), triethylchlorosilane ($(C_2H_5)_3SiCl$), trimethylaminosilane ($(CH_3)_3SiNH_2$) and triethylaminosilane ($(C_2H_5)_3SiNH_2$). Further, the class may also be defined as compounds having another functional group $R_2$—Si—X, such as dimethyldichlorosilane ($(CH_3)_2SiCl_2$). Experiments showed that what has been discussed above with reference to HMDS applies to the other members of the group in substantially the same way.

It will also be understood by those skilled in the art that while ink jet head 1 has been described above as a face nozzle type ink jet head whereby ink drops are ejected from ink nozzles disposed on the surface of a substrate, the present invention can also be applied to edge nozzle ink jet heads in which ink drops are ejected from ink nozzles disposed along an edge of the substrate.

Furthermore, while the present invention has been described as applied to an ink jet head, the invention can also be applied to electrostatic actuators in devices other than ink jet heads. Examples of such other applications include micromechanical devices such as proposed in JP-A-7-54259, display apparatuses using electrostatic actuators, and micropumps.

Effects of the Invention

As described above, an electrostatic actuator according to the present invention comprises a hydrophobic film of a material such as hexamethyldisilazane (HMDS) formed on opposing surfaces of opposing electrode members adapted to be displaced relative to each other by electrostatic force. The molecules of such films are smaller than those of PFDA, and the durability and stability of the films are substantially improved by sealing the space including the hydrophobic film(s) airtight. It is therefore possible by means of the present invention to form a uniform hydrophobic film substantially free of variations in an electrostatic actuator having a narrow gap between opposing electrode members. In addition, an electrostatic actuator with high durability and operating stability can be achieved.

A manufacturing method for an electrostatic actuator according to the present invention forms an airtight seal to the cavity or gap formed between opposing electrode members while the concentration of the hydrophobic film material in the gap is above a specified level after forming the film on the opposing surfaces of opposing electrode members. As a result, a hydrophobic film with outstanding durability can be achieved in a short period of time. Furthermore, durability can also be improved even when the gap is sealed after air exposure for a specific period of time after hydrophobic film formation.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An electrostatic actuator comprising:

a first electrode having a first surface and a second electrode having a second surface opposing the first surface with a gap disposed therebetween;

a driver for displacing said first and second electrodes relative to each other by producing an electrostatic force therebetween;

a hydrophobic film formed on at least one of the first and second surfaces;

a sealing member for sealing said gap and thereby isolating said gap from the atmosphere surrounding the actuator;

wherein said hydrophobic film is formed from a compound having the functional group $R_3$—Si—X, wherein R is selected from the alkyl group.

2. The electrostatic actuator of claim 1, wherein said compound is selected from the group consisting of hexamethyldisilazane, hexaethyldisilazane, trimethylchlorosilane, triethylchlorosilane, trimethyaminosilane and triethyaminosilane.

3. The electrostatic actuator of claim 2, wherein said compound is hexamethyldisilazane.

4. The electrostatic actuator according to claim 3, wherein the hexamethyldisilazane concentration between the first and second opposing surfaces is 0.3% or greater.

5. The electrostatic actuator according to claim 3, wherein the hexamethyldisilazane concentration between the first and second opposing surfaces is 0.5% or greater.

6. The electrostatic actuator according to claim 3, wherein the hexamethyldisilazane concentration between the first and second opposing surfaces is 0.8% or greater.

7. The electrostatic actuator according to claim 2, wherein the compound concentration between the first and second opposing surfaces is a function of the durability of said first and second electrode members.

8. The electrostatic actuator according to claim 2, further comprising:

a tube communicating with said gap between said first and second electrodes; and wherein the relationship between volume (V) of the gap, and the cross-sectional area (S) and length (L) of said tube satisfy the condition: $V \cdot L/S \geqq 25$.

9. The electrostatic actuator according to claim 2, further comprising:

an ink chamber having a volume that changes in response to the relative displacement of said first and second electrodes; and an ink nozzle communicating with said ink chamber;

wherein said driver comprises a pair of electrodes, one formed on each of said first and second electrodes; and a pressure applying mechanism for applying an electrical pulse between said first and second electrodes, such that an ink drop is ejected from said ink nozzle according to an applied electrical pulse.

10. An electrostatic actuator comprising:

a first electrode having a first surface and a second electrode having a second surface opposing the first surface with a gap disposed therebetween;

a driver for displacing said first and second electrodes relative to each other by producing an electrostatic force therebetween;

a hydrophobic film formed on at least one of the first and second surfaces;

a sealing member for sealing said gap and thereby isolating said gap from the atmosphere surrounding the actuator;

wherein the hydrophobic film is formed from an organosilicate compound having a hydrophobic functional group and the ability to react with a hydroxyl group.

11. An electrostatic actuator according to claim 10, wherein the functional group of said organosilicate compound is of the formula:

$R_3Si$ wherein R is selected from the alkyl group.

12. An electrostatic actuator according to claim 10, wherein the functional group of said organosilicate compound is of the formula:

$R_2Si$ wherein R is selected from the alkyl group.

13. An electrostatic actuator according to claim 10, wherein the functional group of said organosilicate compound is of the formula:

$R_2Si$ wherein R is dimethyldichlorosilane.

14. An electrostatic actuator comprising:

a first electrode having a first surface and a second elecrode having a second surface opposing the first surface with a gap disposed therebetween;

a driver for displacing said first and second electrodes relative to each other by producing an electrostatic force therebetween;

HMDS in said gap;

a sealing member for sealing said gap and preventing said HMDS from leaking.

15. The electrostatic actuator according to claim 14, wherein the HMDS concentration in said gap is approximately 0.3% or greater.

16. An electrostatic ink jet head comprising:

a nozzle;

an ink chamber in connection with said nozzle;

a diaphragm for ejecting ink from said nozzle by fluctuating the volume of ink in said ink chamber;

an electrode oppositely facing said diaphragm and separated by a gap, wherein said diaphragm is displaced toward said electrode as a voltage is applied between said diaphragm and said electrode, and said diaphragm returns toward said ink chamber as the voltage is canceled after an appropriate time, causing said ink to eject from said nozzle;

wherein HMDS is disposed in said gap; and a sealing member for sealing said gap and preventing said HMDS from leaking.

17. The electrostatic ink jet head according to claim 16, the HMDS concentration in said gap is approximately 0.3% or greater.

* * * * *